US008075822B1

(12) United States Patent
Strollo et al.

(10) Patent No.: US 8,075,822 B1
(45) Date of Patent: Dec. 13, 2011

(54) STONE-HARD, MOLD-FREE, SCENTED, AND DECORATIVE BEAD AND SIMILAR ARTICLE, AND METHOD OF FABRICATION

(76) Inventors: Lynne A. Strollo, Nesconset, NY (US); Christine Fasano, Deer Park, NY (US)

( * ) Notice: Subject to any disclaimer, the term of this patent is extended or adjusted under 35 U.S.C. 154(b) by 276 days.

(21) Appl. No.: 12/454,921

(22) Filed: May 26, 2009

(51) Int. Cl.
*A44C 27/00* (2006.01)
*B29C 67/24* (2006.01)

(52) U.S. Cl. ..... 264/115; 264/119; 63/38

(58) Field of Classification Search ..... None
See application file for complete search history.

(56) References Cited

U.S. PATENT DOCUMENTS 4,020,156 A 4/1977 Murray et al.
4,293,602 A 10/1981 Coffey et al.
5,316,182 A 5/1994 Lee et al.
6,357,260 B1 3/2002 Lutz
6,381,984 B1 5/2002 Russo et al.
7,556,760 B2 * 7/2009 Rhee et al. ..... 264/331.19
2002/0092323 A1 * 7/2002 Lieberman ..... 63/38
2006/0010914 A1 1/2006 Costanzo
2007/0006614 A1 1/2007 Martz
2009/0010978 A1 * 1/2009 Jensen ..... 424/402
2009/0090133 A1 * 4/2009 Lee ..... 63/38

* cited by examiner

*Primary Examiner* — Mary F Theisen
(74) *Attorney, Agent, or Firm* — Richard L. Miller

(57) ABSTRACT

The method of fabricating a stone-hard, mold-free, scented and decorative bead includes the steps of drying flower petals, finely chopping the dried petals, simmering the finely chopped petals, cooking off excess fluid from the simmered petals and straining to form a pulp, spreading the pulp and placing in a food dehydrator on low setting to form a dried pulp, milling the dried pulp m a flour mill on highest/finest setting to form a petal powder, mixing the petal powder with gum arabic solution and either flower oil or olive oil to form a clay composition, using either a form or hand rolling the clay composition to form a bead, piercing the bead with a pin, rotating the bead on the pin to form a dned bead, removing the dried bead from the pin to form a pierced bead, determining if a smoother surface is desired, if so buffing with final finish sandpaper, and determining if a shiny bead is desired, if so touching lightly petroleum jelly onto the pierced bead and wiping off to shine.

13 Claims, 8 Drawing Sheets

METHOD OF FABRICATION OF THE STONE-HARD, MOLD-FREE, SCENTED, AND DECORATIVE BEAD OR SIMILAR ARTICLE
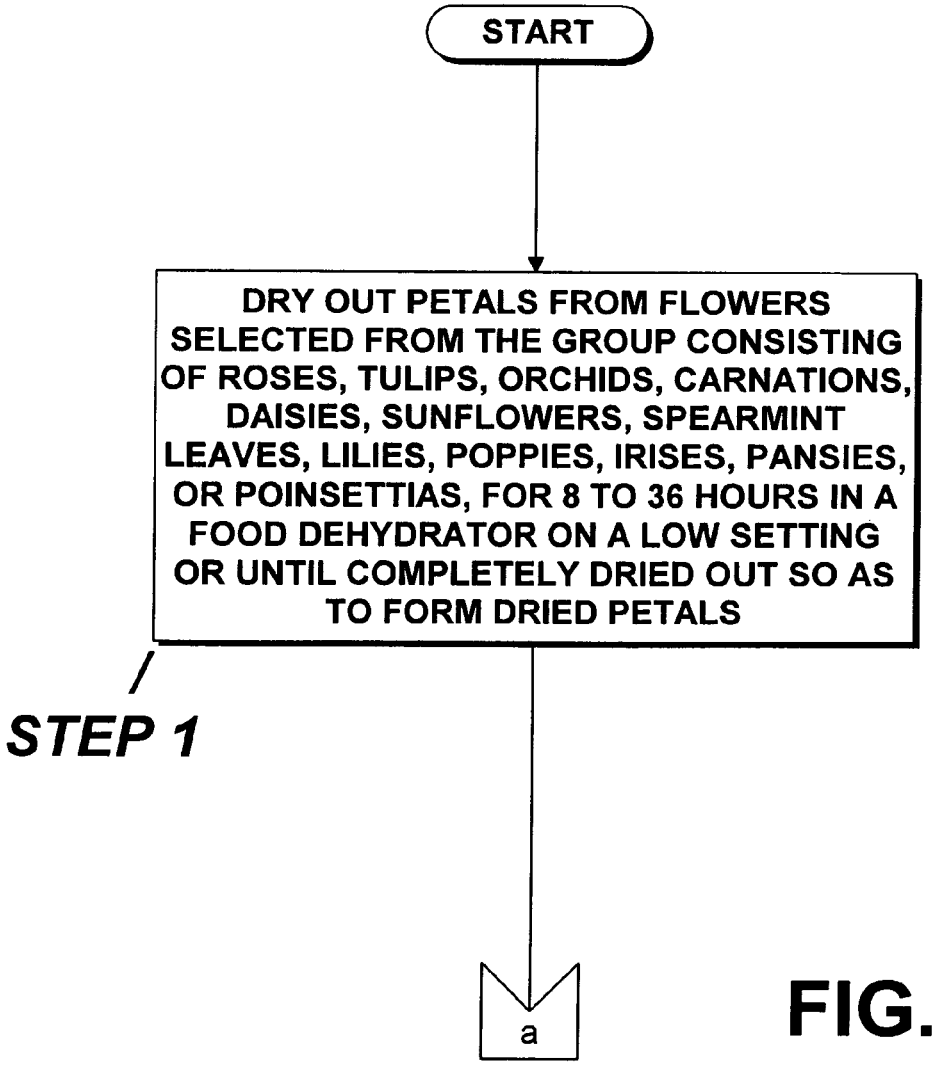
FIG. 1-A

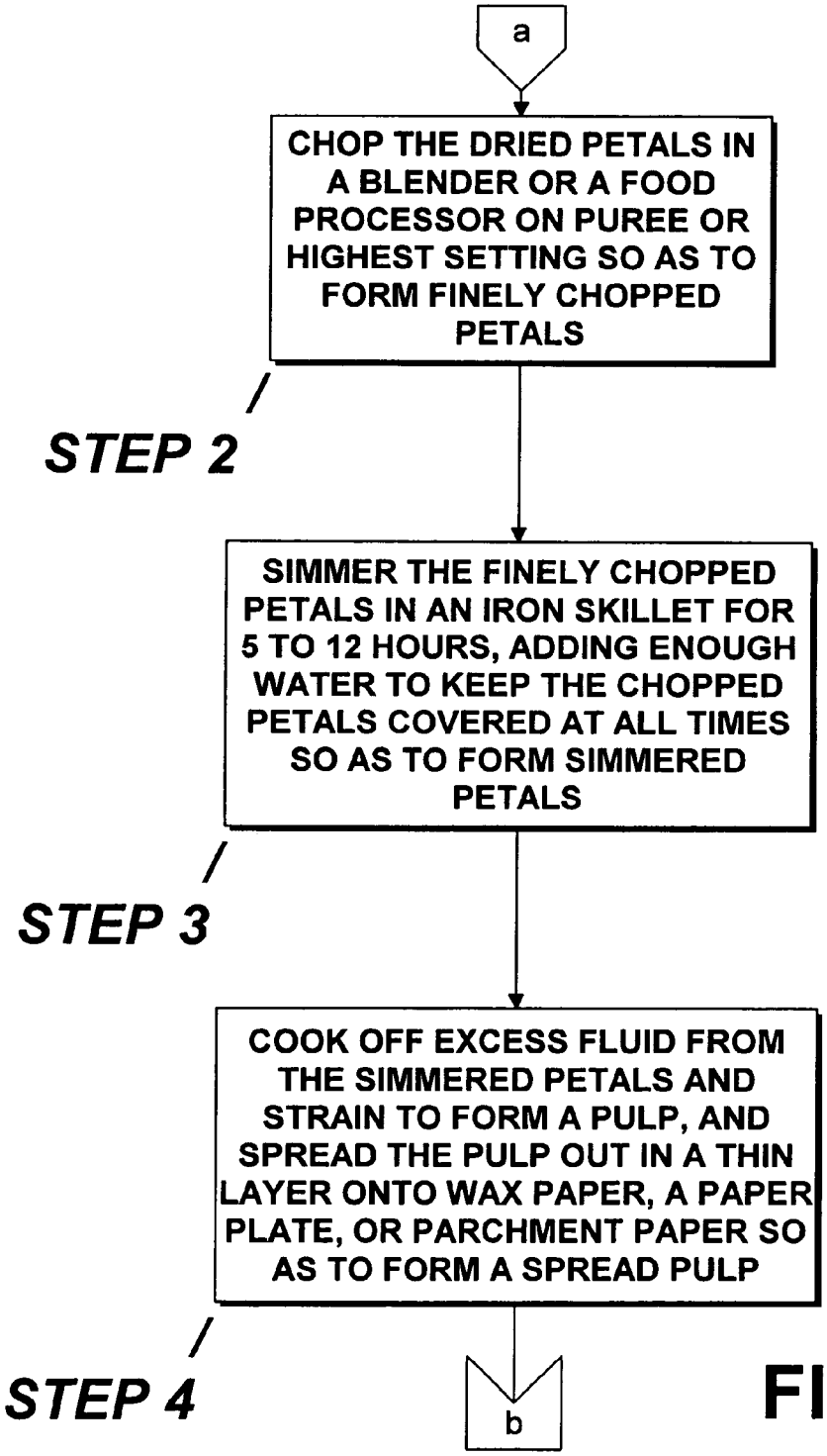
FIG. 1-B

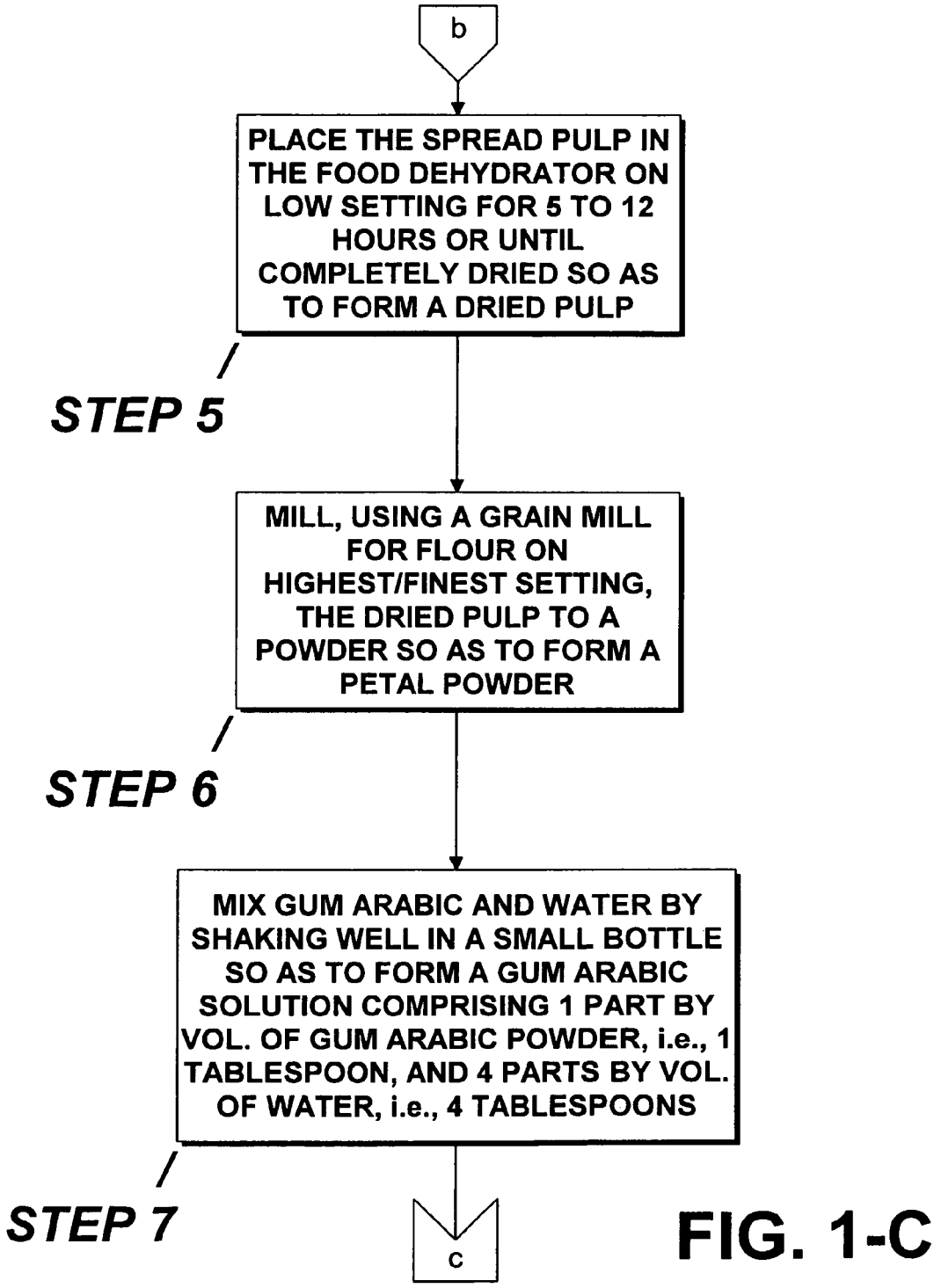
FIG. 1-C

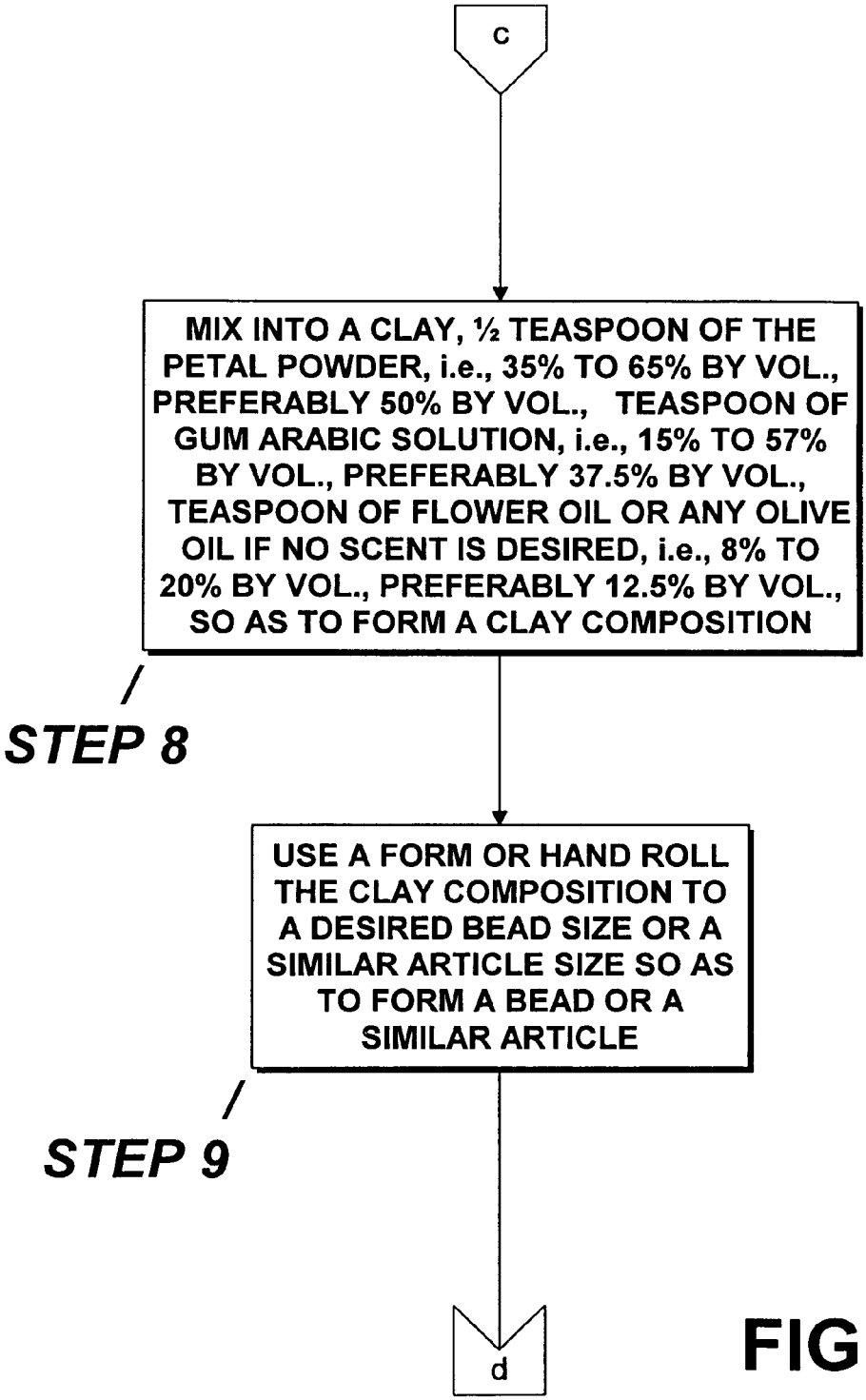
FIG. 1-D

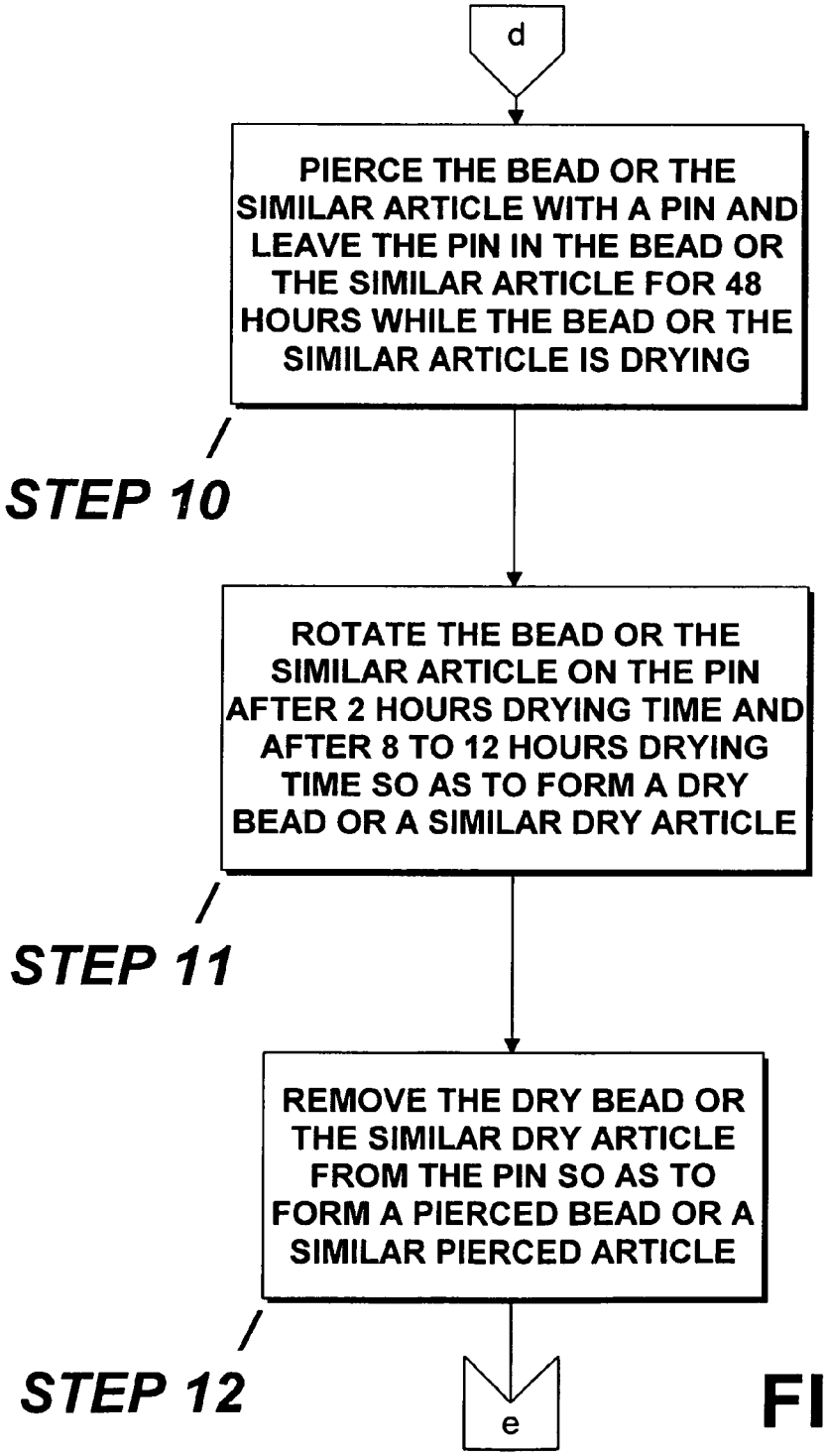
FIG. 1-E

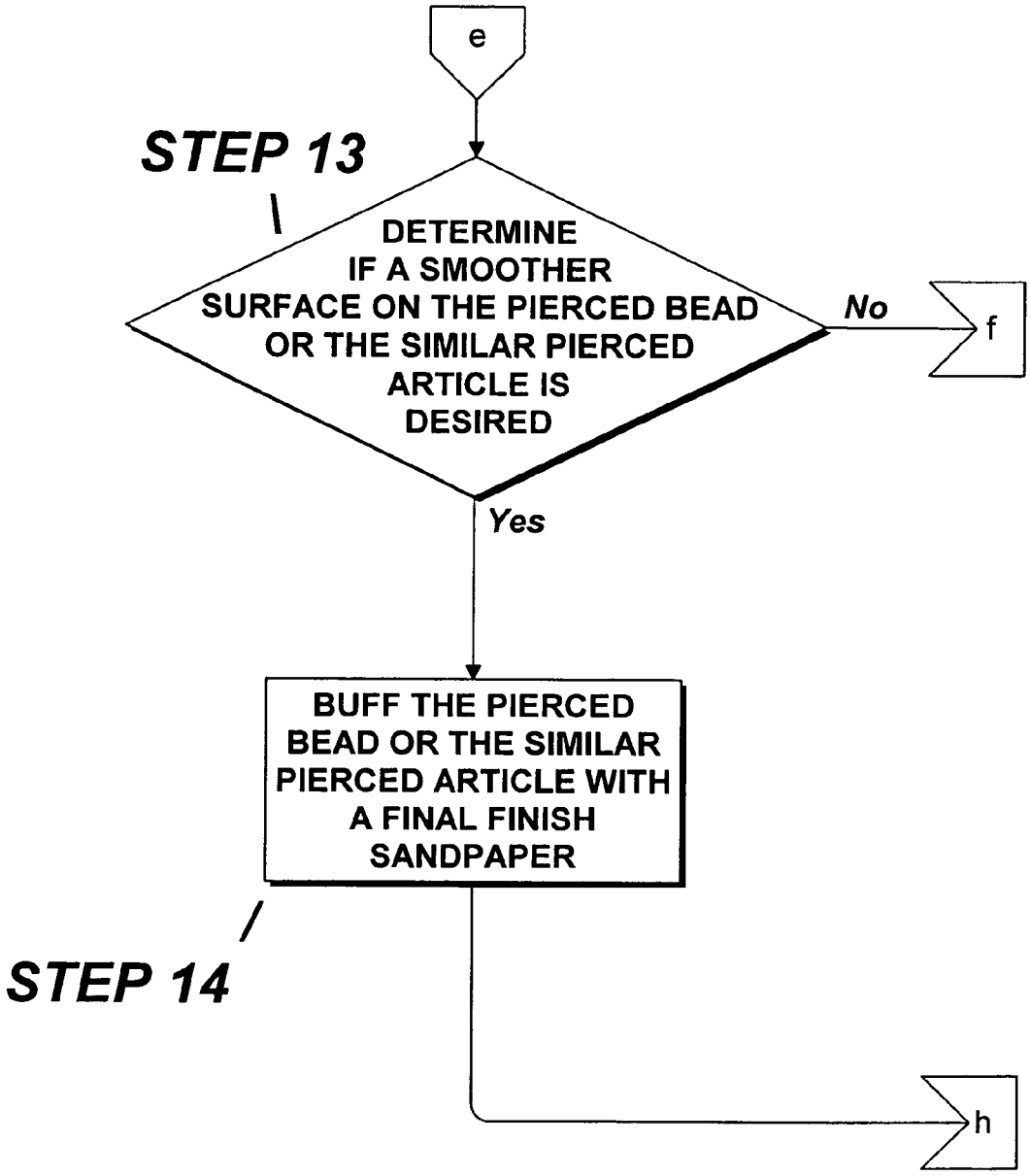
FIG. 1-F

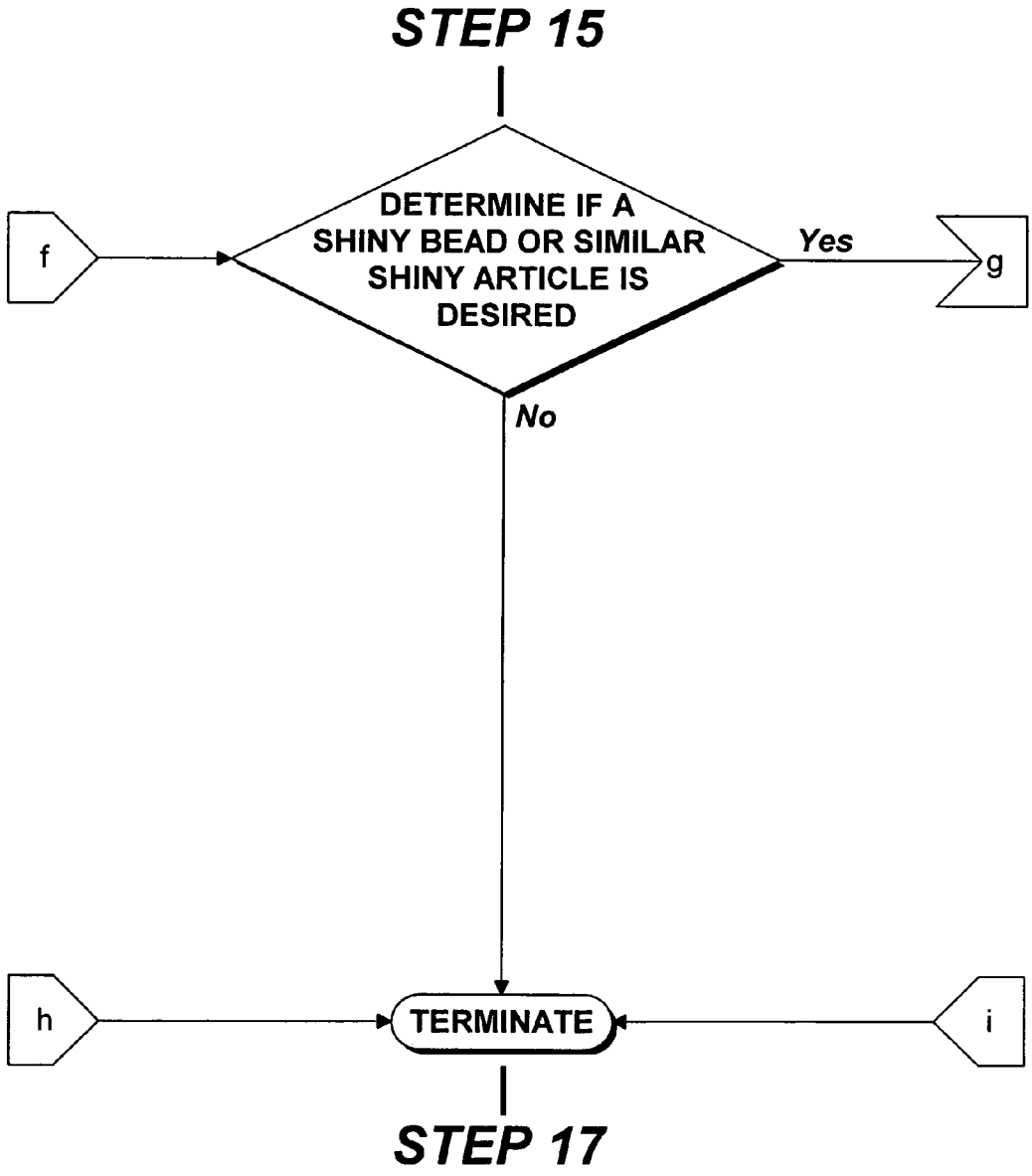
FIG. 1-G

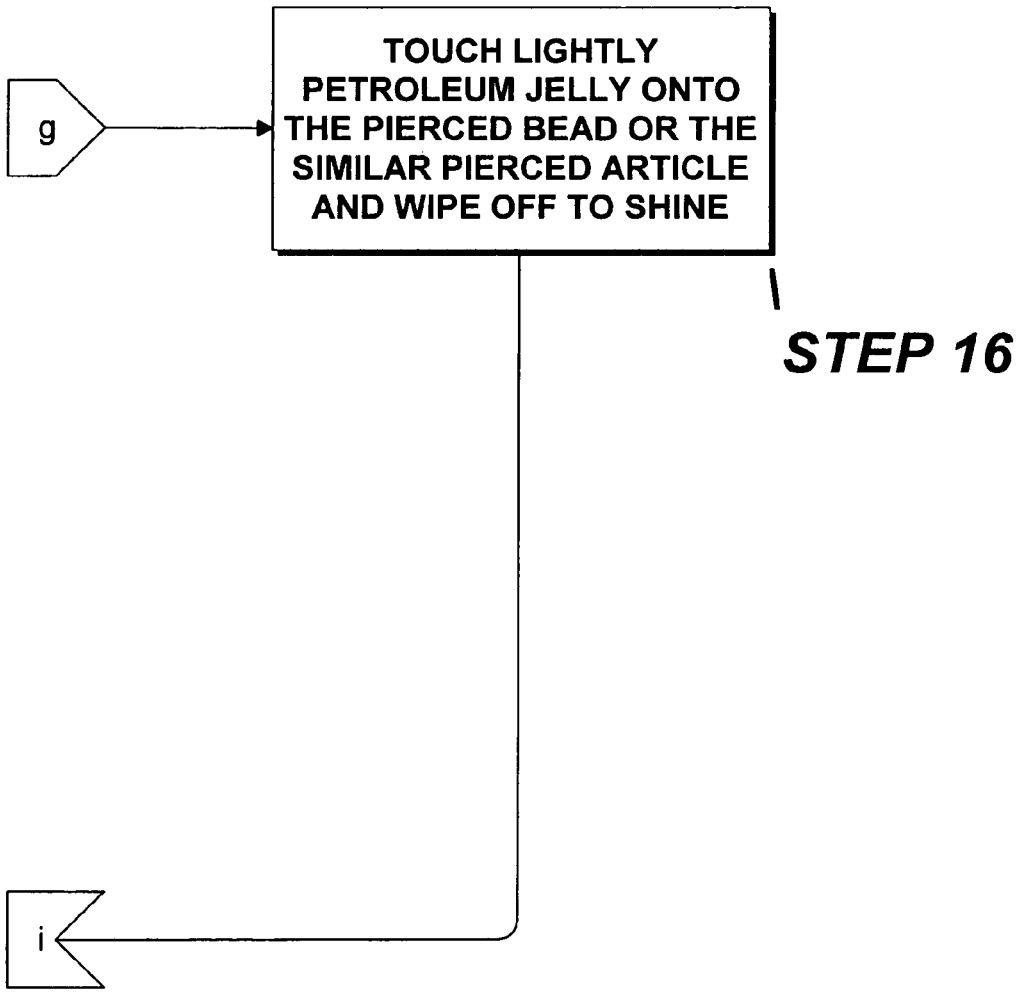
FIG. 1-H

STONE-HARD, MOLD-FREE, SCENTED, AND DECORATIVE BEAD AND SIMILAR ARTICLE, AND METHOD OF FABRICATION

THE BACKGROUND OF THE INVENTION

A. The Field of the Invention.

The embodiments of the present invention relate to a scented bead and similar article, and more particularly, the embodiments of the present invention relate to a stone-hard, mold-free, scented, and decorative bead and similar article, such as, but not limited to, jewelry, rosaries, bookmarks, etc., and method of fabrication.

B. The Description of the Prior Art.

Numerous innovations for scented articles have been provided in the prior art, which will be described below in chronological order to show advancement in the art, and which are incorporated herein by reference thereto. Even though these innovations may be suitable for the specific individual purposes to which they address, however, they differ from the present invention in that they do not teach a stone-hard, mold-free, scented, and decorative bead and similar article, and method of fabrication.

(1) The U.S. Pat. No. 4,020,156 to Murray et al.

The U.S. Pat. No. 4,020,156 issued to Murray et al. on Apr. 26, 1977 in U.S. class 424 and subclass 76 teaches fragrance releasing crystal beads that gradually release a fragrance under anhydrous conditions and provide a rapid release of fragrance when wetted. The beads include a water-soluble particulate carrier, e.g., prilled urea, coated with a finely divided highly absorptive inorganic matrix containing the fragrance. The beads optionally include emollients, bacteriostats, and the like and can be used for pleasingly perfumed sachets, as bath beads, or as agents for the control of malodors in pet litter. The particulate beads may be conspicuously colored so that their color substantially disappears as they are dissolved, giving a visual indication of the need for replenishment.

(2) The U.S. Pat. No. 4,293,602 to Coffey et al.

The U.S. Pat. No. 4,293,602 issued to Coffey et al. on Oct. 6, 1981 in U.S. class 428 and subclass 28 teaches a fragrant ornament, such as a jewelry piece, that includes a mixture of a major amount of a natural botanical plant material, essential oils, and a minor amount of a fluorocarbon resin binder. A method for formulating and molding the ornament is also taught.

(3) The U.S. Pat. No. 5,316,182 to Lee et al.

The U.S. Pat. No. 5,316,182 issued to Lee et al. on May 31, 1994 in U.S. class 222 and subclass 78 teaches a toy in the form of jewelry has a water compartment, a pump or an atomizer, and a source of a perfume scent, which is released when sprayed with water. The source of the scent is, preferably, a simulated jewel containing a bead of scent releasing material. The simulated jewel may be replaced when the scent is exhausted.

(4) The U.S. Pat. No. 6,357,260 B1 to Lutz.

The U.S. Pat. No. 6,357,260 B1 issued to Lutz on Mar. 19, 2002 in U.S. class 63 and subclass 1.11 teaches a scented friendship bracelet kit containing several ornamental beads, a plurality of polymer pellets impregnated with a fragrance, a mesh fabric bundled about the beads and pellets, and a tie string holding the fabric bundle together. The kit is provided as a bundle and can be used as an air freshener.

(5) The U.S. Pat. No. 6,381,984 B1 to Russo et al.

The U.S. Pat. No. 6,381,984 B1 issued to Russo et al. on May 7, 2002 in U.S. class 63 and subclass 1.15 teaches a rechargeable article of jewelry that dispenses perfumed vapors, and has a chamber formed from housing members. The housing members are made of a material containing the perfumed vapors in the chamber and allows for releasing them into the atmosphere. A nugget of unglazed ceramic material is provided in the chamber and is of a size less than the chamber so that it is free to move inside the chamber and allow air to pass around the nugget. The chamber has apertures therein through which an aromatic liquid, such as perfume, can be deposited on and absorbed by the nugget. The apertures also allow air to circulate around the nugget and generate perfumed vapors that may exit the chamber through the apertures. The nugget is larger than any of the apertures so the nugget is retained in the chamber. A method of making scented jewelry is also taught.

(6) The United States patent application Publication Number US 2006/0010914 A1 to Costanzo.

The United States patent application Publication Number US 2006/0010914 A1 published to Costanzo on Jan. 19, 2006 in U.S. class 63 and subclass 36 teaches a high-end fashion decorative natural flora ornament including at least one attachment apparatus and at least one flora that is attached to the attachment apparatus, and the attachment apparatus is fixedly or detachably attachable to a person or to the accouterments of a person, such as a purse, suitcase, or the like. The flora may be a live flower, a dried flower, a grass, an artificial flower, or the like. The attachment apparatus may be an earring made from natural plant material that may be wood, grass, or the like. Alternatively, the earring may be made from a solid material, such as glass, ceramic, paper, plastic, or metal. The metal may be silver, sterling silver, gold, platinum, an alloy, or the like. Alternatively, the attachment apparatus may be a bracelet, necklace, hair apparatus, body-pierced ornament, a clip, such as a tie clip or broach, cufflinks, or a buckle, such as a purse or belt buckle.

(7) The United States patent application Publication Number US 2007/0006614 A1 to Martz.

The United States patent application Publication Number US 2007/0006614 A1 published to Martz on Jan. 11, 2007 in U.S. class 63 and subclass 15 teaches a fragrant decorative jewelry accessory including an infusion of fragrantly volatile molecules into the accessory, and an adhesive on the underside of the accessory intended to removably attach the accessory. Fragrance may be infused on the accessory by soaking an absorbent material with the fragrantly volatile molecules, through a printing technique, through attaching encapsulated fragrance molecules onto the accessory, or through the attachment of an fragrance layer onto the accessory. The fragrant decorative accessory can be removably attached to clothing, a bra strap, a choker, or a hair accessory.

It is apparent that numerous innovations for scented articles have been provided in the prior art that are adapted to be used. Furthermore, even though these innovations may be suitable for the specific individual purposes to which they address, however, they would not be suitable for the purposes of the embodiments of the present invention as heretofore described, namely, a stone-hard, mold-free, scented, and decorative bead and similar article, and method of fabrication.

THE SUMMARY OF THE INVENTION

Thus, an object of the embodiments of the present invention is to provide a stone-hard, mold-free, scented, and decorative bead and similar article, and method of fabrication, which avoids the disadvantages of the prior art.

Briefly stated, another object of the embodiments of the present invention is to provide a stone-hard, mold-free, scented, and decorative bead and similar article, and method of fabrication. The method includes the steps of drying out petals from flowers so as to form dried petals, chopping the dried petals so as to form finely chopped petals, simmering the finely chopped petals so as to form simmered petals, cooking off excess fluid from the simmered petals and strain to form a pulp and spread the pulp out so as to form a spread pulp, placing the spread pulp in a food dehydrator on low setting so as to form a dried pulp, milling the dried pulp in a flour mill on highest/finest setting to a powder so as to form a petal powder, mixing gum arabic solution by shaking well in a small bottle, mixing into a clay the petal powder, the gum arabic solution, and either a flower oil or any olive oil so as to form a clay composition, using either a form or hand roll the clay composition to a desired bead or similar article size so as to form a bead or a similar article, piercing the bead or the similar article with a pin, rotating the bead or the similar article on the pin so as to form a dried bead or a similar dried article, removing the dried bead or the similar dried article from the pin so as to form a pierced bead or a pierced similar article, determining if a smoother surface on the pierced bead or the similar pierced article is desired, if so buffing the pierced bead or the similar pierced article with a final finish sandpaper, determining if a shiny bead or a similar shiny article is desired, and if so touching lightly petroleum jelly onto the pierced bead or the similar pierced article and wipe off to shine.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

THE BRIEF DESCRIPTION OF THE DRAWING

The figures of the drawing are briefly described as follows:

FIGS. 1-A to 1-H are a flowchart of the method of fabrication of the stone-hard, mold-free, scented, and decorative bead and similar article.

THE DETAILED DESCRIPTION OF THE PREFERRED EMBODIMENTS

A. The Composition of the Stone-Hard, Mold-Free, Scented, and Decorative Bead or Similar Article The stone-hard, mold-free, scented, and decorative bead or similar article of the embodiments of the present invention comprises a clay, ½ teaspoon of petal powder, i.e., 35% to 65% by vol., preferably 50% by vol., ⅜ teaspoon of gum arabic solution, i.e., 15% to 57% by vol., preferably 37.5% by vol., ⅛ teaspoon of flower oil or any olive oil if no scent is desired, i.e., 8% to 20% by vol., preferably 12.5% by vol., so as to form a clay composition.

B. The Method of Fabrication of the Stone-Hard, Mold-Free, Scented, and Decorative Bead or Similar Article The method of fabrication of the stone-hard, mold-free, scented, and decorative bead or similar article can best be seen in FIGS. 1-A to 1-H, which are a flowchart of the method of fabrication of the stone-hard, mold-free, scented, and decorative bead or similar article, and as such, will be discussed with reference thereto.

The method of fabrication of the stone-hard, mold-free, scented, and decorative bead or similar article comprises the steps of:

STEP 1: Drying out petals from flowers selected from the group consisting of roses, tulips, orchids, carnations, daisies, sunflowers, spearmint leaves, lilies, poppies, irises, pansies, or poinsettias, for 8 to 36 hours in a food dehydrator on a low setting or until completely dried out so as to form dried petals.

STEP 2: Chopping the dried petals in a blender or a food processor on puree or highest setting so as to form finely chopped petals.

STEP 3: Simmering the finely chopped petals in an iron skillet for 5 to 12 hours, adding enough water to keep the chopped petals covered at all times so as to form simmered petals.

STEP 4: Cooking off excess fluid from the simmered petals and strain to form a pulp, and spread the pulp out in a thin layer onto wax paper, a paper plate, or parchment paper so as to form a spread pulp.

STEP 5: Placing the spread pulp in the food dehydrator on low setting for 5 to 12 hours or until completely dried so as to form a dried pulp.

STEP 6: Milling, using a grain mill for flour on highest/finest setting, the dried pulp to a powder so as to form a petal powder.

STEP 7: Mixing gum arabic powder and water by shaking well in a small bottle so as to form a gum arabic solution comprising 1 part by vol. of gum arabic powder, i.e., 1 tablespoon, and 4 parts by vol. of water, i.e., 4 tablespoons.

STEP 8: Mixing into a clay, ½ teaspoon of the petal powder, i.e., 35% to 65% by vol., preferably 50% by vol., ⅜ teaspoon of gum arabic solution, i.e., 15% to 57% by vol., preferably 37.5% by vol., ⅛ teaspoon of flower oil or any olive oil if no scent is desired, i.e., 8% to 20% by vol., preferably 12.5% by vol., so as to form a clay composition.

STEP 9: Using a form or hand roll the clay composition to a desired bead size or a similar article size so as to form a bead or a similar article.

STEP 10: Piercing the bead or the similar article with a pin and leave the pin in the bead or the similar article for 48 hours while the bead or the similar article is drying.

STEP 11: Rotating the bead or the similar article on the pin after 2 hours drying time and after 8 to 12 hours drying time so as to form a dried bead or a similar dry article.

STEP 12: Removing the dry bead or the similar dry article from the pin so as to form a pierced bead or a similar pierced article.

STEP 13: Determining if a smoother surface on the pierced bead or the similar pierced article is desired.

STEP 14: Buffing the pierced bead or the similar pierced article with a final finish sandpaper, if answer to STEP 13 is yes, and proceeding to STEP 15, if answer to STEP 13 is no.

STEP 15: Determining if a shiny bead or similar shiny article is desired.

STEP 16: Touching lightly petroleum jelly onto the pierced bead or the similar pierced article and wipe off to shine, if answer to STEP 15 is yes, and proceeding to STEP 17, if answer to STEP 15 is no.

STEP 17: Terminating.

C. The Impressions

It will be understood that each of the elements described above or two or more together may also find a useful application in other types of constructions differing from the types described above.

While the embodiments of the present invention have been illustrated and described as embodied in a stone-hard, mold-free, scented, and decorative bead and similar article, and method of fabrication, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

It is to be particularly noted that the clay may be formed into an infinite variety of various articles that are not beads, and accordingly, are too numerous to mention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A method of fabrication of a stone-hard, mold-free, scented, and decorative bead, comprising the steps of:

a) drying out petals from flowers so as to form dried petals;
b) chopping the dried petals so as to form finely chopped petals;
c) simmering the chopped petals so as to form simmered petals;
d) cooking off excess fluid from the simmered petals and strain to form a pulp, and spread the pulp out so as to form a spread pulp;
e) placing the spread pulp in a food dehydrator on low setting so as to form a dried pulp;
f) milling, using a grain mill for flour, the dried pulp to a powder so as to form a petal powder;
g) mixing gum arabic powder and water so as to form a gum arabic solution;
h) mixing into a clay, the petal powder, gum arabic solution, flower oil and/or olive oil so as to form a clay composition;
i) using one of a form or hand roll the clay composition to a desired bead size or so as to form a bead;
j) piercing the bead with a pin;
k) rotating the bead on the pin so as to form a dried bead; and
l) removing the dried bead from the pin so as to form a pierced bead.

2. The method of claim 1, wherein said drying out step includes drying out petals from flowers selected from the group consisting of roses, tulips, orchids, carnations, daisies, sunflowers, spearmint leaves, lilies, poppies, irises, pansies, and poinsettias.

3. The method of claim 1, wherein said drying out step includes drying out petals for one of 8 to 36 hours in a food dehydrator on a low setting and until completely dried out.

4. The method of claim 1, wherein said chopping step includes chopping the dried petals in one of a blender or a food processor on one of puree or highest setting.

5. The method of claim 1, wherein said simmering step includes simmering the chopped petals in an iron skillet for 5 to 12 hours and adding enough water to keep the chopped petals covered at all times.

6. The method of claim 1, wherein said cooking step includes cooking off excess fluid from the simmered petals and strain to form a pulp, and spread the pulp out in one of a thin layer onto wax paper, a paper plate, or parchment paper.

7. The method of claim 1, wherein said placing step includes placing the spread pulp in a food dehydrator on low setting for one of 5 to 12 hours and until completely dried.

8. The method of claim 1, wherein said second mixing step includes mixing into a clay, ½ teaspoon of the petal powder, ⅜ teaspoon of gum arabic solution, and ⅛ teaspoon of one of flower oil and/or olive oil.

9. The method of claim 1, wherein said piercing step includes piercing the bead with a pin and leave the pin in the bead for 48 hours while the bead is drying.

10. The method of claim 1, wherein said rotating step includes rotating the bead on the pin after 2 hours drying time and after 8 to 12 hours drying time.

11. The method of claim 1, further comprising the steps of:

l) determining if a smoother surface on the pierced bead is desired;
m) buffing the pierced bead with a final finish sandpaper, if answer to step l) is yes and proceeding to step n, if answer to step l) is no;
n) determining if one of a shiny bead is desired; and
o) touching lightly petroleum jelly onto the pierced bead and wipe off to shine, if answer to step n) is yes and terminating, if answer to step n) is no.

12. The method of claim 1, wherein said second mixing Step includes mixing into a clay, 35% to 65% by vol. of the petal powder, 15% to 57% by vol. of gum arabic solution, and 8% to 20% by vol. of one of flower oil and/or any olive oil.

13. The method of claim 1, wherein said second mixing step includes mixing into a clay, 50% by vol. of the petal powder, 37.5% by vol. of gum arabic solution, and 12.5% by vol. of one of flower of 1 and/or any olive oil.

* * * * *